US007328732B2

(12) United States Patent
Chuang

(10) Patent No.: US 7,328,732 B2
(45) Date of Patent: Feb. 12, 2008

(54) SWIFTLY AND MINUTELY ADJUSTING DEVICE FOR A WOOD-PLANER WORKING TABLE

(76) Inventor: Bor-Yann Chuang, No. 78, Yungfeng Rd., Taiping City, Taichung (TW) 411

( * ) Notice: Subject to any disclaimer, the term of this patent is extended or adjusted under 35 U.S.C. 154(b) by 105 days.

(21) Appl. No.: 11/245,215

(22) Filed: Oct. 7, 2005

(65) Prior Publication Data

US 2007/0079901 A1 Apr. 12, 2007

(51) Int. Cl.
*B27C 1/00* (2006.01)

(52) U.S. Cl. ..... 144/253.8; 144/253.5; 144/286.5; 144/287

(58) Field of Classification Search ..... 144/114.1, 144/117.1, 129, 253.1, 253.5, 253.6, 253.8, 144/286.1, 287, 286.5; 269/289 R; 108/1–3, 108/5–7, 145–147, 71
See application file for complete search history.

(56) References Cited

U.S. PATENT DOCUMENTS 5,143,128 A * 9/1992 Chen ..... 144/117.1
5,533,557 A * 7/1996 Jedlicka et al. ..... 144/253.8
5,979,521 A * 11/1999 Garcia ..... 144/129
6,390,425 B1 * 5/2002 Juang ..... 248/188.2
6,494,239 B1 * 12/2002 Liao ..... 144/129
6,513,557 B1 * 2/2003 Chuang ..... 144/129

* cited by examiner

*Primary Examiner*—Shelley M. Self
(74) *Attorney, Agent, or Firm*—Ming Chow; Sinorica, LLC

(57) ABSTRACT

A swiftly and minutely adjusting device for a wood-planer working table includes a bottom base, a stationary working table, a movable working table, a linking rod unit, an adjusting device, a guide plate and a tightening grip. The movable working table is slidably combined on the bottom base. The adjusting device and the linking rod unit are pivotally connected to a support shaft to permit the adjusting device move the linking rod unit for swiftly adjusting the height of the movable working table. A worm gear is attached on the support shaft, and the adjusting device has a worm shaft and a bevel gear unit for adjusting minutely the support shaft, so the movable working table of a wood planer can be adjusted minutely as well.

7 Claims, 7 Drawing Sheets

SWIFTLY AND MINUTELY ADJUSTING DEVICE FOR A WOOD-PLANER WORKING TABLE

BACKGROUND OF THE INVENTION

1. Field of the Invention

This invention relates to a wood planer working table, particularly to an adjusting device for swiftly at first and next minutely adjusting the working table of a wood planer.

2. Description of the Prior Art

A conventional swiftly and minutely adjusting wood planer working table disclosed in a U.S. Pat. No. 6,513,557B1 shown in FIG. 1 includes mainly an elevating lever 1 for moving a working table 2 swiftly and minutely.

However, the conventional swiftly and minutely adjusting device for a wood planer working table is controlled by the elevating lever 1, and a user has to go near to the side of the wood planer for carrying out minute adjustment, not convenient to handle.

SUMMARY OF THE INVENTION

The swiftly and minutely adjusting device for a wood planer working table in the invention utilizes a support shaft for swiftly raising and lowering of a movable working table to a necessary height. And a bevel gear unit included in the adjusting device can move the support shaft to minutely adjusting the movable working table. So a wood planer can be adjusted swiftly and minutely, and the location of the adjusting device is located at the front end of the working table, enhancing convenience of operation of the adjusting device.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
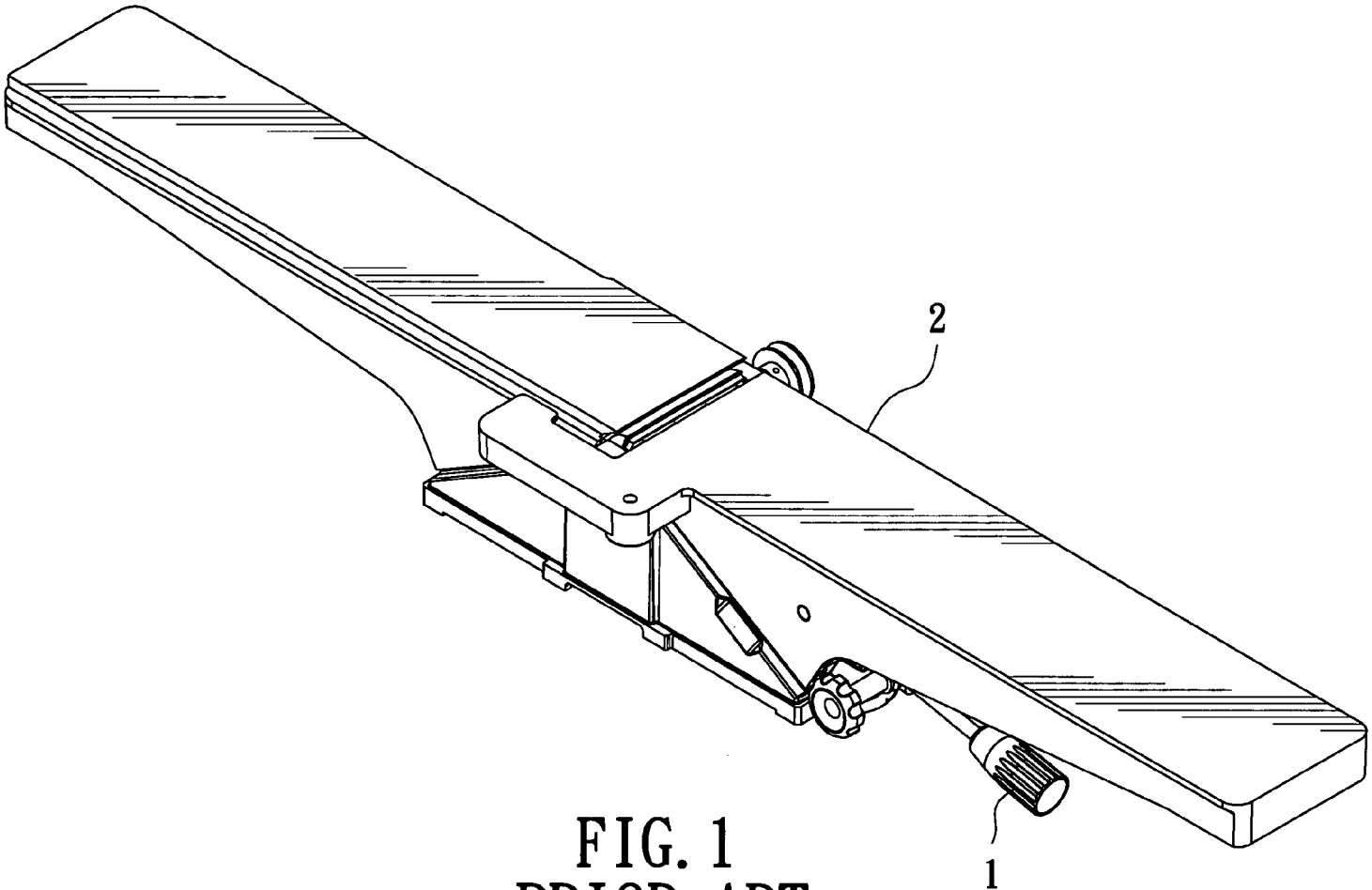
FIG. 1 PRIOR ART
FIG. 1 is a perspective view of a conventional wood planter with a swiftly and minutely adjusting device for a working table.
Figure 2:
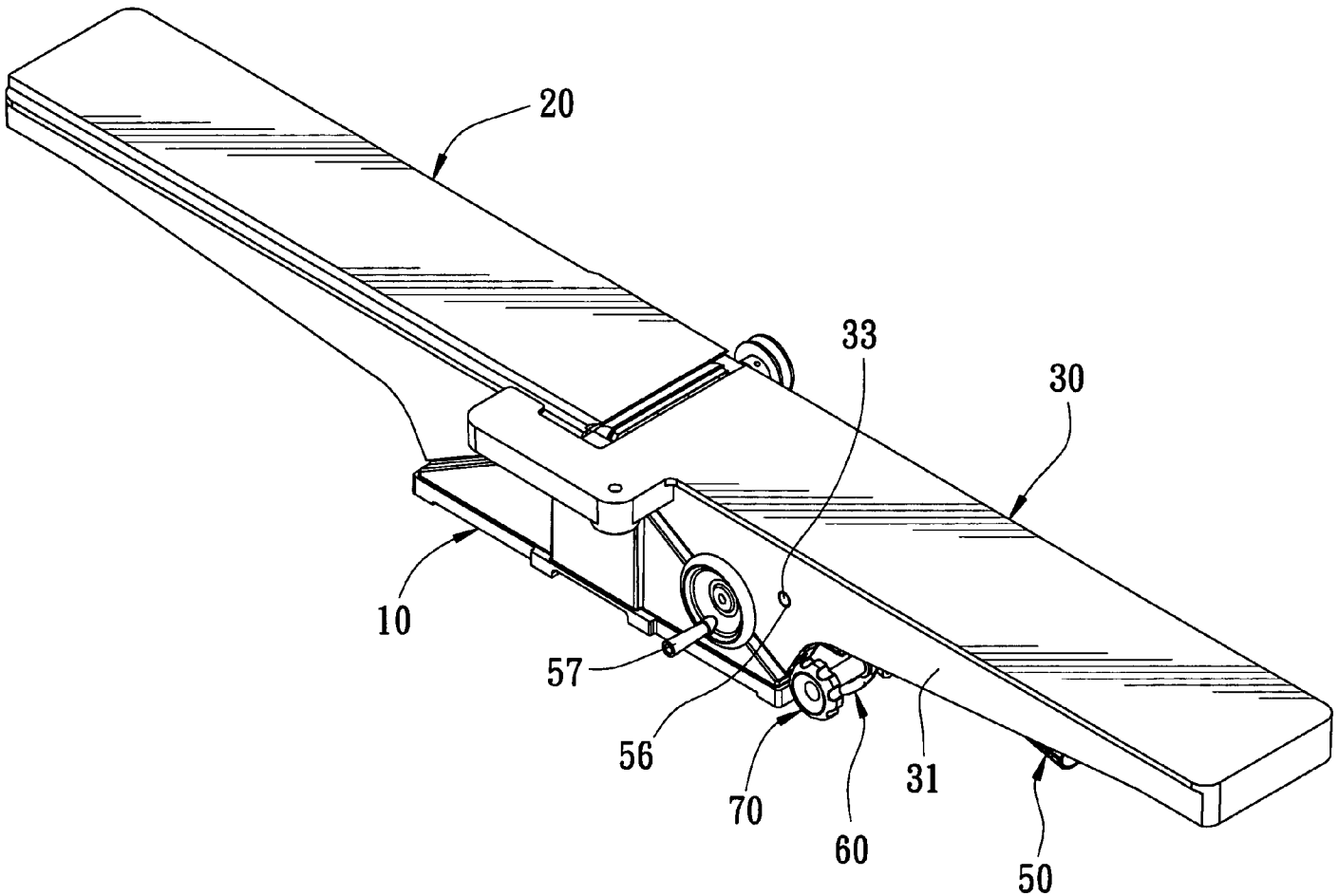
FIG. 2 is a perspective view of a wood planer with a swiftly and minutely adjusting device for a working table in the present invention.
Figure 3:
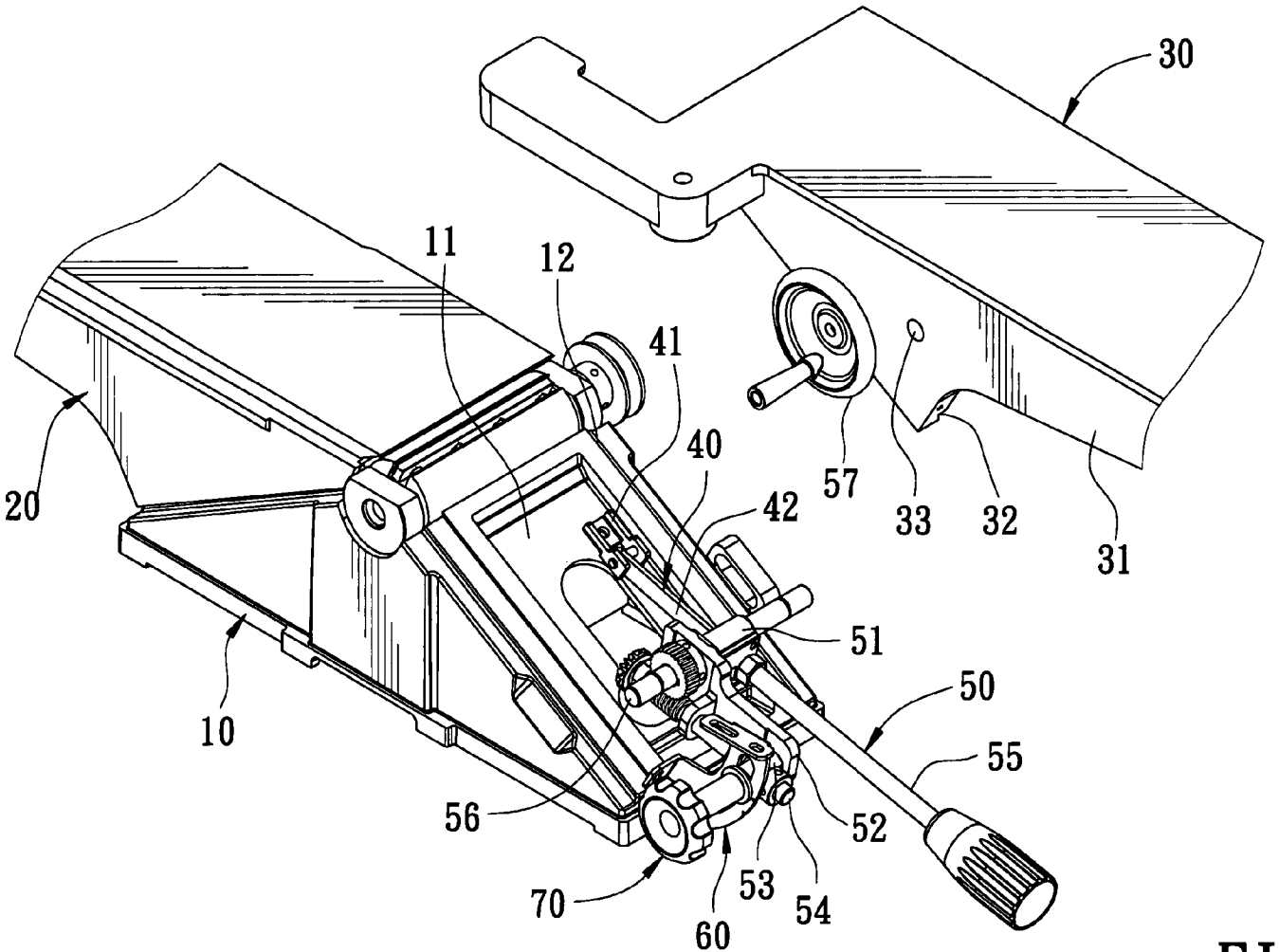
FIG. 3 is partial exploded perspective view of the wood planer in the present invention.

A preferred embodiment of a swiftly and minutely adjusting device for a wood planer working table in the present invention is shown in FIGS. 2 and 3, and the wood planer includes a bottom base 10, a stationary working table 20, a movable working table 30, a linking device 40, an adjusting device 50, a guide plate 60, and a tightening handle 70 as main components combined together.

The bottom base 10 is provided with a sloped surface 11 in the right side, a dovetail-shaped slide plate 12 respectively formed at a front and a rear side of the sloped surface 11, and a threaded hole 13 respectively in the front and the rear side at a preset location.

The stationary working table 20 is fixed at the left side of the bottom base 10.

The movable working table 30 is slidably deposited on the sloped surface 11 at the right side, having a side plate 31 respectively at two lengthwise sides, and a dovetail-shaped hole 32 to face the dovetail-shaped slide plate 12 so that the movable working table may slide on the bottom base 10. Further, the two side plates 31 respectively have a fixing hole 33 symmetrically located.

The linking rod unit 40 has a fixing base 41 positioned at the front end of the sloped surface 11, and the fixing base 41 has a hole 412 in its front end for a screw 411 to screw the fixing base 41 in the thread hole 13 of the bottom base 10. Further, the fixing base 41 has a side plate 413 respectively at two opposite sides, and each side plate 413 has a pivotal hole 414 aligned to each other, with a shaft pin 415 pivotally connecting a linking rod 42 with the fixing base 41 by fitting in a pivot hole 421 bored in a front end of the linking rod 42, which also has a pivot hole 422 in the rear end.

Next, The adjusting device 50 is composed of an adjusting base 51, an elevating base 52, a fixing block 53, a worm shaft 54, an elevating rod 55, a support shaft 56 and a bevel gear unit 57.

The adjusting base 51 has a threaded hole 511 lengthwise in a lower portion for a bolt 43 to screw with and engage with the pivot hole 422 of the linking rod 42, and the bolt 43 has a round shank 431 to contact with the linking rod 42 so that the linking rod 42 may rotate relative to the adjusting base 51. The adjusting base 51 further has a lengthwise hole 512 in an upper portion, a threaded hole 513 respectively spaced apart in a rear sidewall and communicating with the hole 512, and a threaded hole 514 in the bottom.

The elevating base 52 is shaped as a narrow plate, having a first sidewise projection 521 with a round hole 522 at the front end, and a second sidewise projection 523 with a round hole 524 at the intermediate portion. The round hole 522 and the round hole 524 have their center aligned, and the round hole 522 has a longer diameter than that of the round hole 524. Further, the elevating base 52 has a shaft hole 525 in an upper end aligned to the lengthwise hole 512 of the adjusting base 51, and a fixing hole 526 in a rear end.

Figure 4:
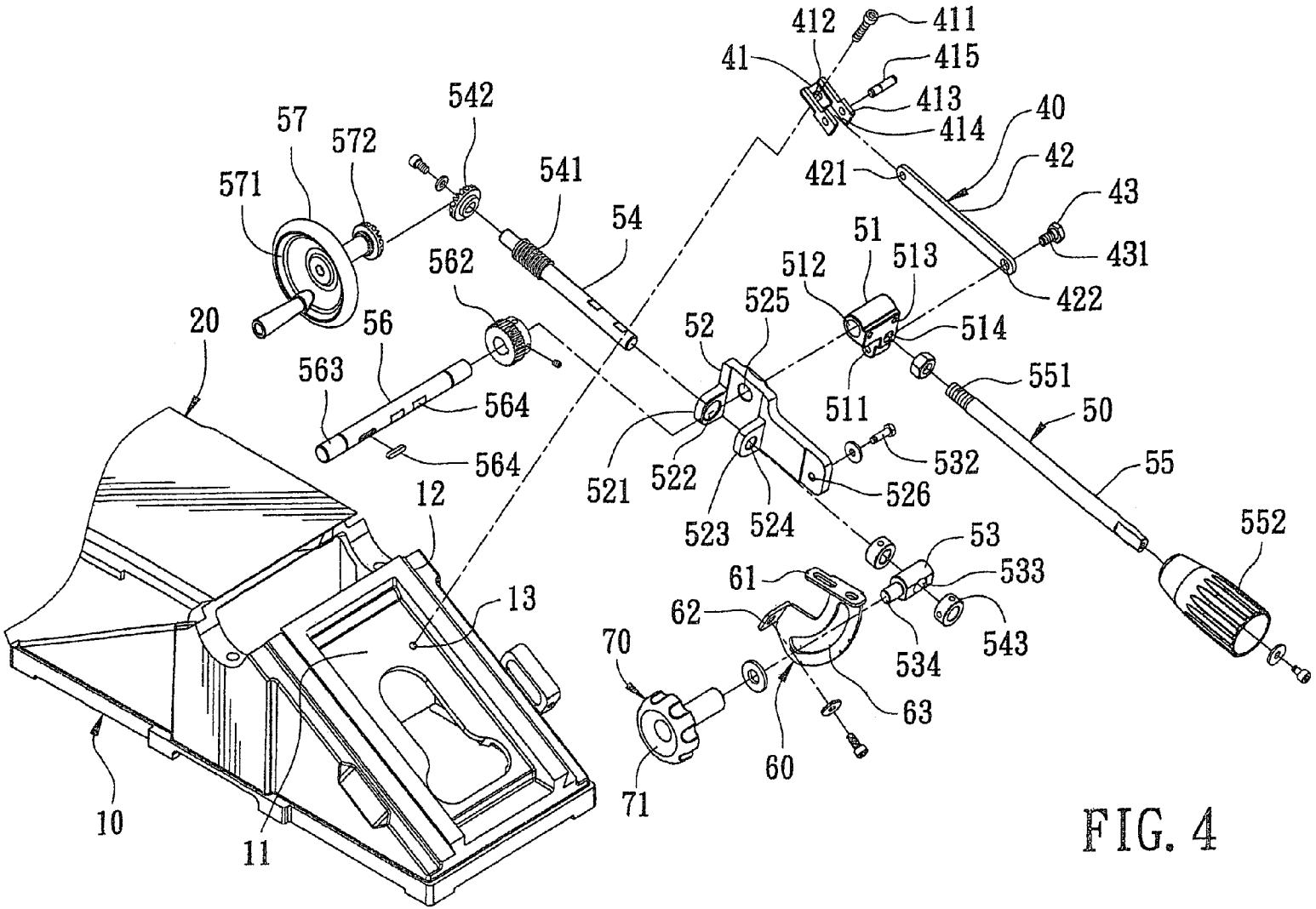
FIG. 4 is an exploded perspective view of the swiftly minutely and adjusting device in the present invention.

The fixing block 53 is shaped as a column as shown in FIG. 4, having a threaded hole 531 in the center of a rear side for a bolt 532 to fix the fixing block to the elevating base 52 by engaging with the fixing hole 526. The fixing block 53 further has a round hole 533 corresponding to the round hole 524 of the elevating base 52, and a round slide rod 534 formed in a front end and having male threads around the surface of its end.

The worm shaft 54 has a worm 541 in a front end section, and its front end section fitted in the rounds holes 522 and 524, with the worm 541 just located between the two round holes 522 and 524. The worm shaft 54 has a first bevel gear 542 fixed on the front end, with its rear end fitting in the round hole 533 of the fixing block 53, and with a limit block 543 respectively fixed at two opposite sides of the fixing block 53 so as to stabilize the fixing block 53 on a preset location on the worm shaft 54.

Next, the elevating rod 55 is round and elongate, having a male-threaded front end 551 having a diameter smaller than other portions of the elevating rod 55 so as to engage tightly with the threaded hole 514 of the adjusting base 51, and the rear end tightly combined with a grip 552.

The support shaft 56 has a double-head round key 561 for fixing a second worm gear 562 engaging with the worm 541, and extends through the shaft hole 525 of the elevating base 52 and the lengthwise hole 512 of the adjusting base 51. The support shaft 56 further has two ends 563 respectively fitting in the fixing hole 33 of the two side plates 31 of the movable working table 30, and two flat faces 564 formed spaced apart on an outer surface of the intermediate portion and corresponding to the two threaded holes 513 of the adjusting base 51. Then two screws screw in the two threaded holes 513 and tightly urge the two flat faces 564 for tightly combining the support shaft 56 with the adjusting base 51.

The bevel gear unit 57 is composed of a rotatable arm 571 connected to a preset location of an outer side of the movable working table 30, a second bevel gear 572 positioned inside the movable working table 30 and engaging with the bevel gear 542 attached on the worm shaft 54.

The guide plate 60 is shaped as C, having a top horizontal plate 61 fixed at a preset location on the bottom of the movable working table 30, and a side plate 62 at one side fixed on a side of the bottom of the movable working table 30, and a curved slot 63 extending almost vertically.

The tightening grip 70, as shown in FIG. 4, consists of a round rod 71 with a threaded hole 72 for the slide rod 534 of the fixing block 53 to pass first through the slide hole 63 and then having the male threads of the slide rod 534 to engage with.

Figure 5:
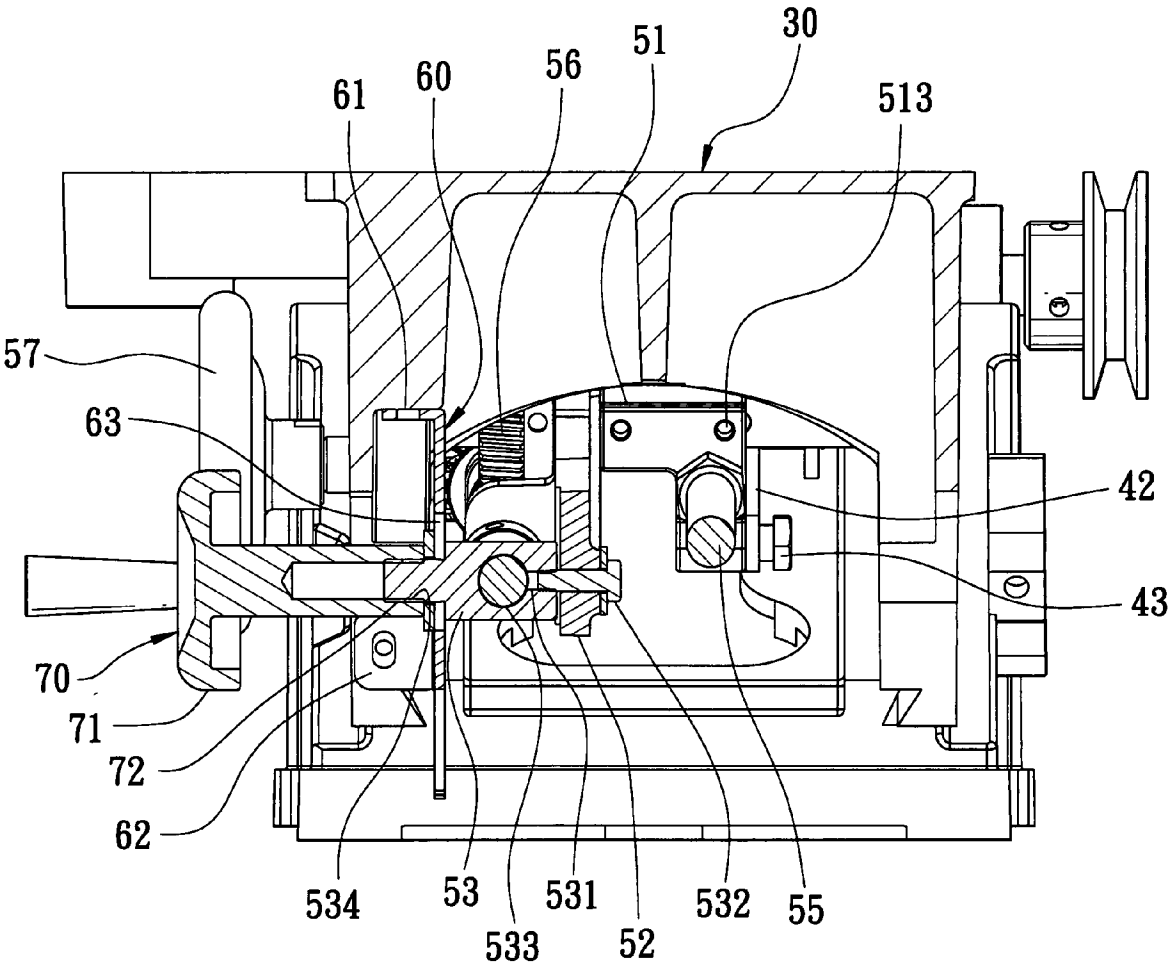
FIG. 5 is a cross-sectional view of a tightening grip and its related components in the present invention.
Figure 6:
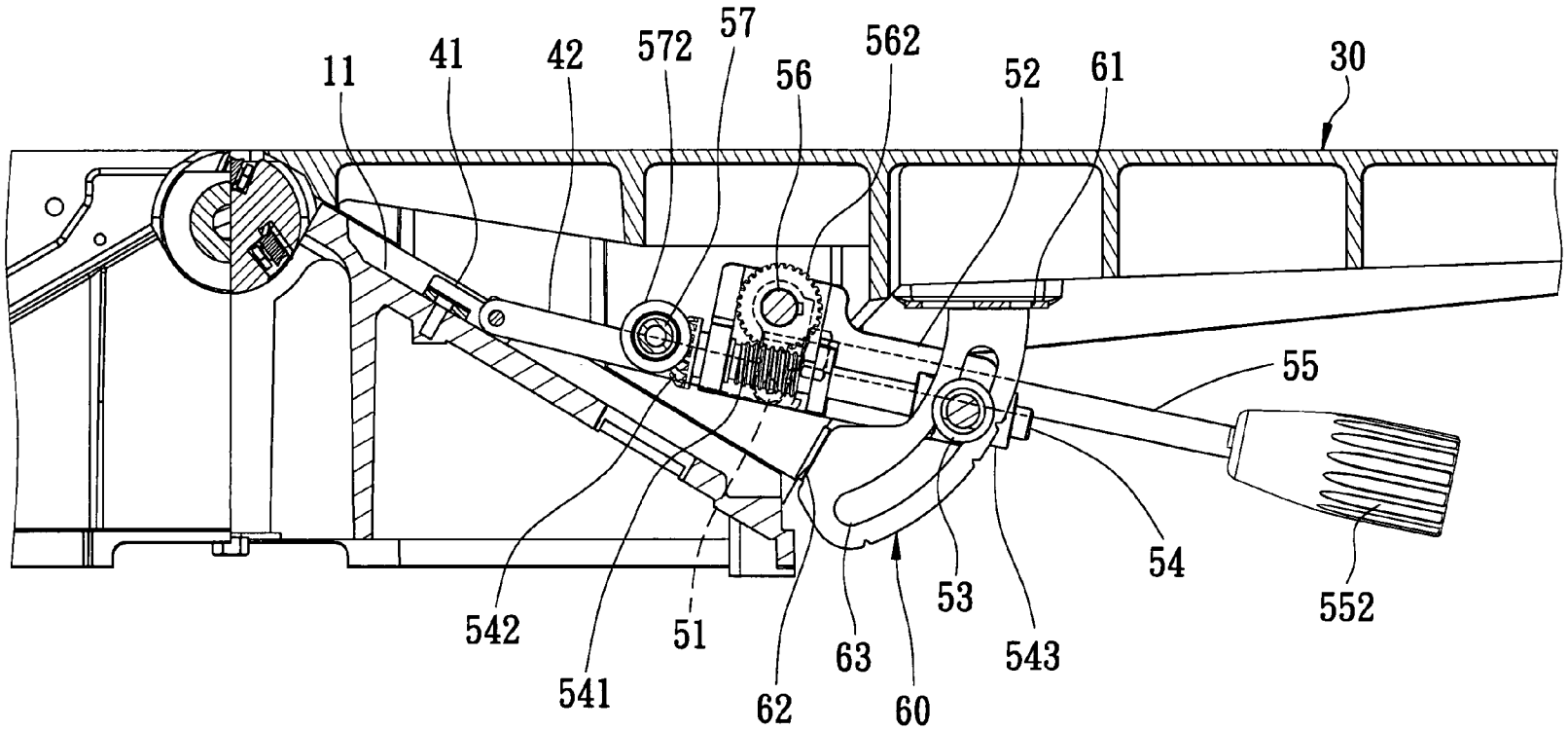
FIG. 6 is a side cross-sectional view of the swiftly and minutely adjusting device under a stopped condition for the working table in the present invention; and, FIG. 7 is a side cross-sectional view of the swiftly and minutely adjusting device having moved down the working table in the present invention.
Figure 7:
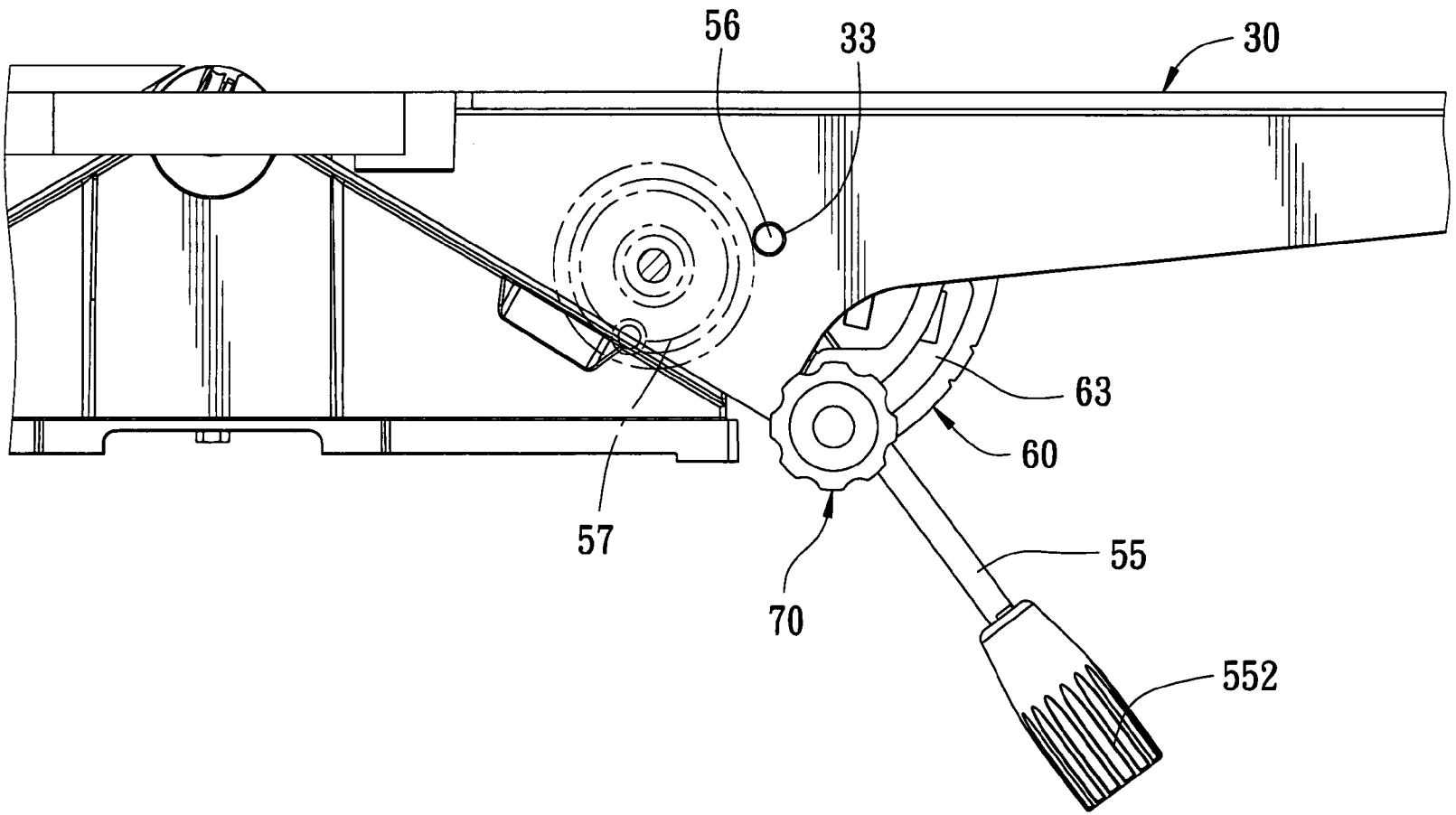

Next, how to use the swiftly and minutely adjusting device is to be described as follows. As shown in FIGS. 5, 6 and 7, in order to adjust the height of the movable working table 30, first loosen the tightening grip 70, letting the slide rod 534 of the fixing block 53 slide in the slide slot 63 of the guide plate 60, and then press down the grip 552 of the elevating rod 55 so the movable working table 30 may pivotally be connected to the elevating base 52 and the adjusting base 51 by means of the support rod 56. As the adjusting base 51 is connected with the linking rod 42 and the fixing base 41 has the bolt 413 functioning as a fulcrum, the linking rod 42 may indirectly transmit movement, guided by the slide slot 63 of the guide plate 60 in case of the grip 52 being pressed down so that the movable working table 30 may be lowered down, as shown in FIG. 7.

On the contrary, if the movable working table 30 is to be raised up, its largest stroke is limited by the slot 63 of the guide plate 60, and the slot 63 is curved, permitting the adjusting movement and its control carried out smoothly without any hitch.

Next, if a minute adjustment is wanted, as shown in FIGS. 3, 6 and 7, rotate the rotatable arm 571 at the outside of the movable working table 30, and then the second bevel gear 572 is to be rotated, rotating the first bevel gear 542 of the worm shaft 54 so the worm 541 is also rotated to turn the worm gear 562. Therefore, the worm gear 562 may rotate the support shaft 56 minutely, so the adjusting base 51 fixed with the support shaft 56 is moved also minutely. Thus the movable working table 30 may be moved up and down minutely by the support shaft 55 through the linking rod 42 connected with the adjusting base 51.

In general, the adjusting device for a wood planer in the invention has the advantage that the movable working table is first adjusted swiftly to the approximate height and then adjusted minutely by the two stages of adjustment, upgrading its productivity and quality and enhancing convenience for operation.

While the preferred embodiment of the invention has been described above, it will be recognized and understood that various modifications may be made therein and appended claims are intended to cover all such modifications that may fall within the spirit and scope of the invention.

What is claimed is:

1. A swiftly and minutely adjusting device for a wood-planer working table, said wood planer comprising a base, said base having a sloped surface at one half side, a movable working table slidably positioned on said sloped surface, a link rod unit having one end pivotally connected to said sloped surface:

said adjusting device pivotally connected to one end side of a linking rod of said linking rod unit and consisting of an adjusting base, an elevating base, a fixing block, a worm shaft, an elevating rod, a support shaft and a bevel gear unit;

said adjusting base pivotally connected to said linking rod so that said linking rod and said adjusting base may rotate to each other, said adjusting base further having an upper end provided with a lengthwise hole for a support shaft to extend through, said elevating rod fixed with a lower end of said adjusting base;

said elevating base positioned at a front end of said adjusting base, said worm shaft fittingly connected with said elevating base, said support shaft connected firmly with said elevating base;

said worm shaft having a worm formed on a front end section, a first bevel gear fixed on said front end, said worm shaft further having its rear end fitted in said fixing block;

said support shaft having a worm gear attached firmly thereon, said worm gear engaging with said worm of said worm shaft, said support shaft further having two ends respectively and pivotally connected to said movable working table;

a bevel gear unit consisting of a second bevel gear deposited in said movable working table and a rotatable arm positioned in an outer side of said movable working table and connected to said second bevel gear, said second bevel gear engaging with said first bevel gear of said worm shaft.

2. The swiftly and minutely adjusting device for a wood-planer working table as claimed in claim 1, wherein a guide plate is positioned below said movable working table, said guide plate having a slide slot, a slide rod formed at an outer side of said fixing block and movably fitting in said slide slot, said adjusting device possible to move smoothly up and down along said slide slot, said slide rod having male threads on an outer end to extend through the guide plate and then engage with a tightening grip.

3. The swiftly and minutely adjusting device for a wood-planer working table as claimed in claim 1, wherein said movable working table is further provided with a lengthwise side plate at two opposite sides, and said two side plates respectively have one fixing hole for said support shaft to be pivotally connected to said movable working table.

4. The swiftly and minutely adjusting device for a wood-planer working table as claimed in claim 1, wherein said adjusting base further has two threaded holes in a rear side, said threaded holes communicate with said lengthwise hole, and said support shaft has two flat faces corresponding to said two threaded holes of said adjusting base.

5. The swiftly and minutely adjusting device for a wood-planer working table as claimed in claim 1, wherein said elevating base is shaped as a narrow plate, having two sidewise projections spaced apart and respectively provided with a round hole, the two sidewise projections having centers aligning with each other so said worm shaft may be limitedly positioned in said elevating base.

6. The swiftly and minutely adjusting device for a wood-planer working table as claimed in claim 1, wherein two limit blocks are attached on said worm shaft respectively at two outer sides of said fixing block.

7. The swiftly and minutely adjusting device for a wood-planer working table as claimed in claim 1, wherein said linking rod and said adjusting base are pivotally connected to each other with a bolt, and said bolt has a round shank to contact with said linking rod.

* * * * *